United States Patent [19]

Hawker et al.

[11] Patent Number: 4,718,440

[45] Date of Patent: Jan. 12, 1988

[54] NON ELECTRIC DISHWASHER

[75] Inventors: Brian Hawker, Kent, United Kingdom; Joseph Faggard, Orange County, Calif.

[73] Assignee: AC Industries, Ltd., United Kingdom

[21] Appl. No.: 777,174

[22] Filed: Sep. 18, 1985

Related U.S. Application Data

[63] Continuation-in-part of Ser. No. 739,879, May 31, 1985, abandoned.

[51] Int. Cl.[4] ..... B08B 3/02

[52] U.S. Cl. ..... 134/141; 134/153; 134/200

[58] Field of Search ..... 134/53, 137, 138, 139, 134/140, 141, 143, 153, 200

[56] References Cited

U.S. PATENT DOCUMENTS

| | | | |
|---|---|---|---|
| 1,261,778 | 4/1918 | Deming | 134/141 X |
| 1,264,792 | 4/1918 | Hayward | 134/138 |
| 1,553,013 | 9/1925 | Turman | 134/138 |
| 2,372,205 | 3/1945 | Hertz | 134/141 X |
| 2,702,558 | 2/1955 | Blanchard | 134/138 |
| 4,368,747 | 1/1983 | Taylor | 134/138 X |

FOREIGN PATENT DOCUMENTS

| | | | |
|---|---|---|---|
| 521771 | 5/1940 | United Kingdom | 137/141 |

*Primary Examiner*—Harvey C. Hornsby
*Assistant Examiner*—Frankie L. Stinson
*Attorney, Agent, or Firm*—James E. Brunton

[57] ABSTRACT

An improved water powered dishwasher uniquely adapted to be operated by a domestic water supply line of either high, low or medium pressure including a housing, a rack rotatably mounted within the housing, the rack being adapted to support articles to be washed and a water jet subassembly for directing jets of water in the direction of the rack to impart rotational movement thereto. The jet subassembly comprises a collimated jet for emitting a collimated stream of water in the direction of the lower periphery of the rack for initiating and assisting in sustaining the rotation thereof and a second spray jet for washing the articles and for urging forward rotation of the rack. The dishwasher also embodies a novel control mechanism, including a timer valve for controlling the period of time water flows toward the jet means and a diverter assembly for controlling the collimated jet so as to urge forward rotation of the rack in low water pressure conditions, or, alternatively, to accomplish braking of the rotation of the rack under high water pressure conditions.

14 Claims, 16 Drawing Figures

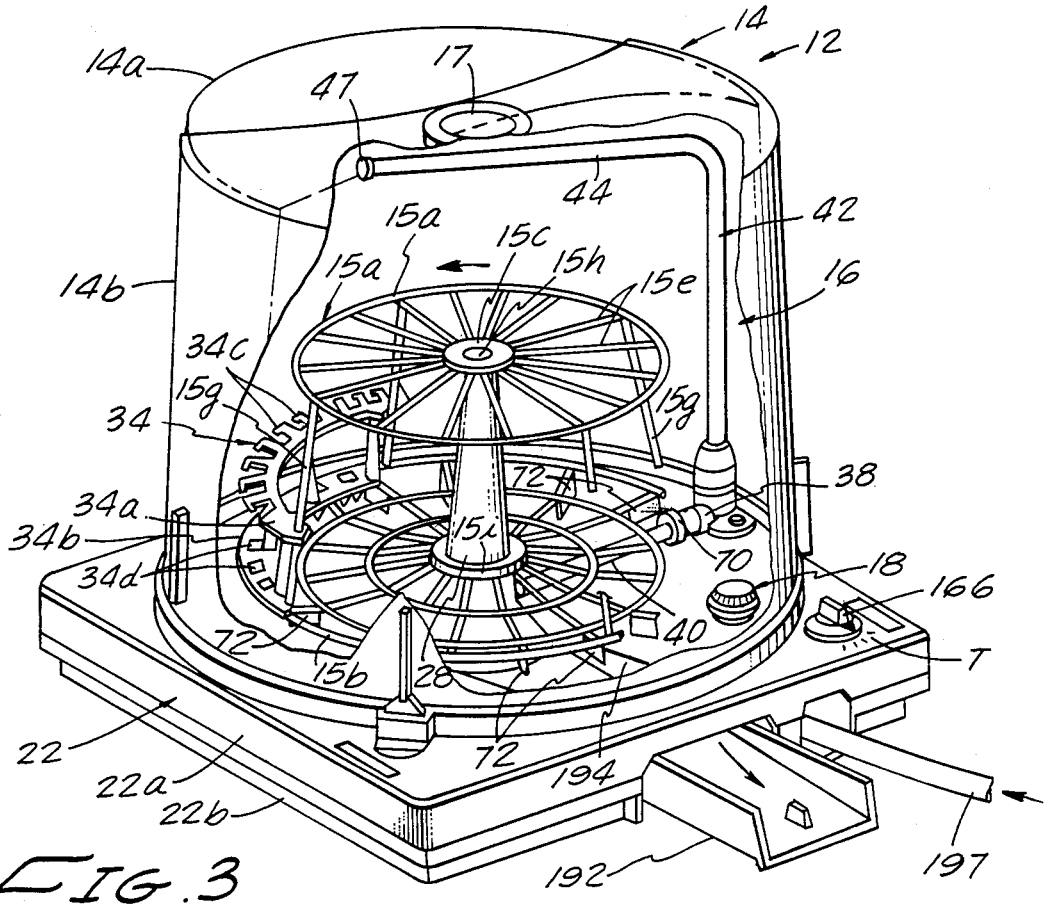
FIG. 3
FIG. 4
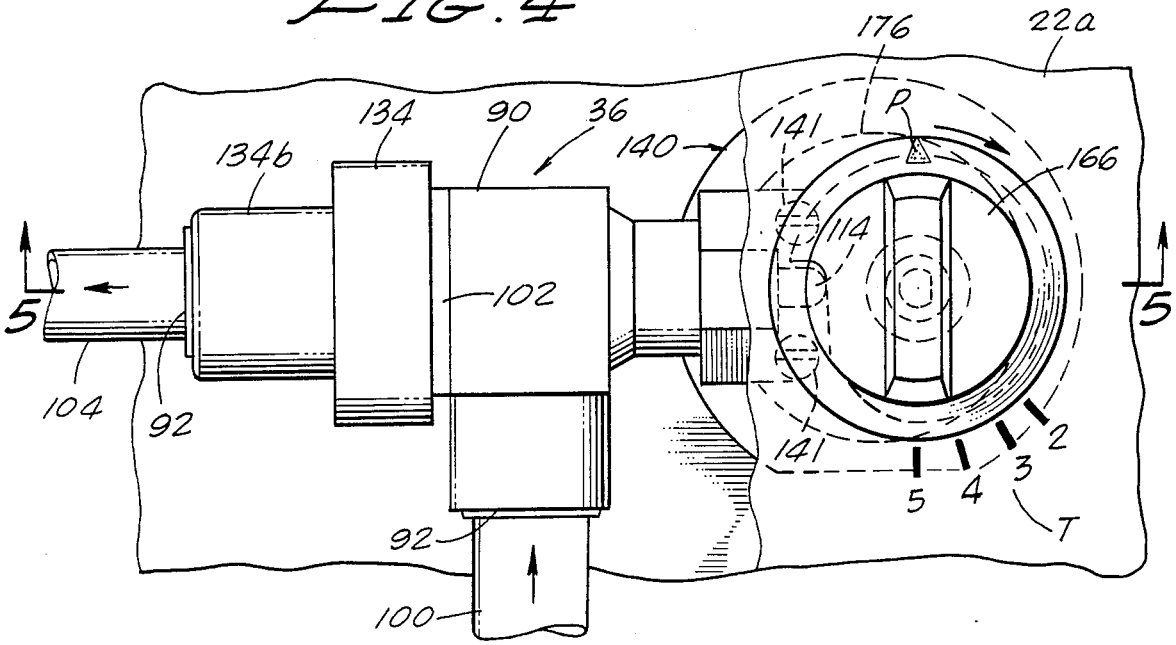

NON ELECTRIC DISHWASHER

This is a continuation-in-part application of copending application Ser. No. 739,879 filed May 31, 1985, now abandoned.

BACKGROUND OF THE INVENTION

1. Field of the Invention

The present invention relates generally to dishwashers and more particularly to a non-electric, self-contained, dish-washer unit adapted to be removably interconnected with either a high pressure, medium pressure or low pressure domestic water supply.

2. Discussion of the Prior Art

Portable dishwashers operable solely by water pressure are not new. Several such units have been manufactured and sold in recent years. A common drawback of such units, however, has been their inability to rapidly and effectively clean dishes and cookware and their inability to operate satisfactorily when connected to domestic water supplies.

Many of the prior art units are cheaply constructed and have been sold more as a novelty item than as a bona fide, high performance dishwashing device. Generally, the washing action in such units is attempted by one or more rapidly rotating emitters located beneath or along side a rack holding the dishes. These emitters, which operate in much the same manner as lawn sprinklers, have proven ineffective in the removal of most troublesome types of food residue on the dishes. Other types of emitters have from time to time been tried, but for the most part have also proven to be ineffective.

Included among the most effective dishwasher units ever developed are the units discussed in U.S. Pat. Nos. 4,368,747 and 4,444,213. These units, for the first time, overcome the quality and performance drawbacks inherent in their predecessor prior art devices. Like the apparatus of these earlier designs, the present invention is not a toy, or a novelty item, but rather is a carefully engineered, high performance device adapted to rapidly and efficiently remove even the most difficult food residue from dishes and cookware. The improved water jet means of the unit of the present invention controllably directs a multiplicity of high velocity water jets at the articles to be washed while they are supported within the unit on a unique holding rack which is precisely rotated at an optimum rate of speed without regard to the pressure of the domestic water supply. These water jets can be directed to impinge upon all the surfaces of the dishes supported within the rotating rack and create a unique scrubbing type of action which loosens and dislodges even the most difficult of residues. A dosing chamber of improved design precisely mixes an emulsifier, such as liquid soap, with the water upstream of the water jets thereby enhancing the cleaning efficiency of the device.

A important aspect of the present invention is the improved water jet means which enables the unit to work at peak efficiency even when attached to domestic water systems having very low pressures of on the order of 5 to 10 psi. The water jet means comprises an adjustable first collimated jet means which can be used in low water pressure situations to initiate and assist in sustaining the rotation of the rotatable rack which supports the dirty dishes. The water jet means also includes an adjustable second spray jet means which accomplishes the efficient scrubbing and cleansing action and also functions to sustain the rotation of the rack. The control means which are operably associated with the jet means permit the collimated jet means to be used at full pressure in low water pressure conditions, to be discontinued under normal water pressure conditions or to be used in high water pressure conditions to effect a braking action to the rotating rack. Accordingly, the unique control means of the invention permits the rack to always be rotated at an optimum rate of speed for maximum cleaning efficiency by the spray jet means regardless of the water pressure of the domestic water source to which the apparatus is connected.

The spray jet means of the device is readily adjustable with respect to the rack so that a multiplicity of fine, very high velocity water jets bombard the dishes from all angles, from above, from below and from the sides. The unique hole pattern formed in the spray jet means permits optimum controlled rotation of the supporting rack while at the same time accomplishing maximum cleaning and scrubbing of the dishes.

Another important aspect of the present invention resides in the provision of a novel timer valve apparatus embodied in the dishwasher unit for automatically and adjustably controlling the period of time during which the domestic water will flow into the unit.

SUMMARY OF THE INVENTION

It is an object of the present invention to provide an improved non-electric free standing, self-contained rotatable dishwasher for washing dishes, cookware and the like which is operated solely by domestic water pressure either at high, medium or low pressure with equal effectiveness.

It is another object of the invention to provide a dishwasher of the aforementioned character in which, in operation, a multiplicity of very fine high velocity jets of water are directed at the articles to be washed from a multiplicity of directions, said jets being of such force as to quickly and efficiently dislodge and thoroughly clean even the most stubborn of food residues and greases.

It is another object of the invention to provide a dishwasher of the character described in which means are provided for uniformly and controllably mixing a soap or detergent with the high velocity water jets.

Another object of the invention is to provide a dishwasher as described in the previous paragraph in which, under low water pressure conditions, a first collimated water jet is directed at the rotatable rack to initiate and assist in sustaining rotation of the rack. Under medium water pressure conditions, on the other hand, the collimated water jet can be closed and the full force of the water directed toward a jet spray system which sustains the rotation of the rack. Under high water pressure conditions the novel control mechanism of the invention uniquely permits the first jet to be used to brake the speed of rotation of the rack. The novel design of the control mechanism of the invention thusly permits the easy and rapid regulation of the collimated jet means from a forward drive mode to an off mode to a braking mode.

A further object of the invention is to provide an improved dishwasher of the class described which is compact, light weight, highly attractive and extremely simple to use and maintain.

Another object of the invention is to provide a dishwasher of the aforementioned character which can be readily interconnected to domestic water outlets without the use of special tools and which includes drain means for conveniently draining the unit into an existing kitchen or bathroom sink.

Still another object of the invention is to provide an improved dishwasher of the class described in which there is provided a novel timer valve means which can be set from the exterior of the unit to precisely control the time period during which water will flow to the unit during the washing cycle and to automatically and positively shut off the water supply at the completion of the washing cycle.

These and other objects of the invention are realized by an improved rotatable dishwasher adapted to be connected to a domestic water supply line comprising a housing, a rack rotatably mounted within the housing, the rack being adapted to support articles to be washed, jet means for directing a jet of water in the direction of said rack to impart rotational movement thereto, the jet means comprising a collimated jet for emitting a collimated stream of water in the direction of the lower peripheral portion of the rack when the apparatus is used with domestic water supplies having very high or very low pressures and a spray jet means for emitting a multiplicity of water spray jets in the direction of the rack during the washing cycle. A novel timer means controls the time period during which water will flow toward the jet means.

BRIEF DESCRIPTION OF THE DRAWINGS

FIG. 3 is a generally perspective view of the assembled dishwasher.

FIG. 4 is a fragmentary plan view of portions of a portion of the control means of the invention showing the configuration of the timer valve for controlling the flow of water received from the domestic water line.

DESCRIPTION OF ONE FORM OF THE INVENTION

Figure 1:
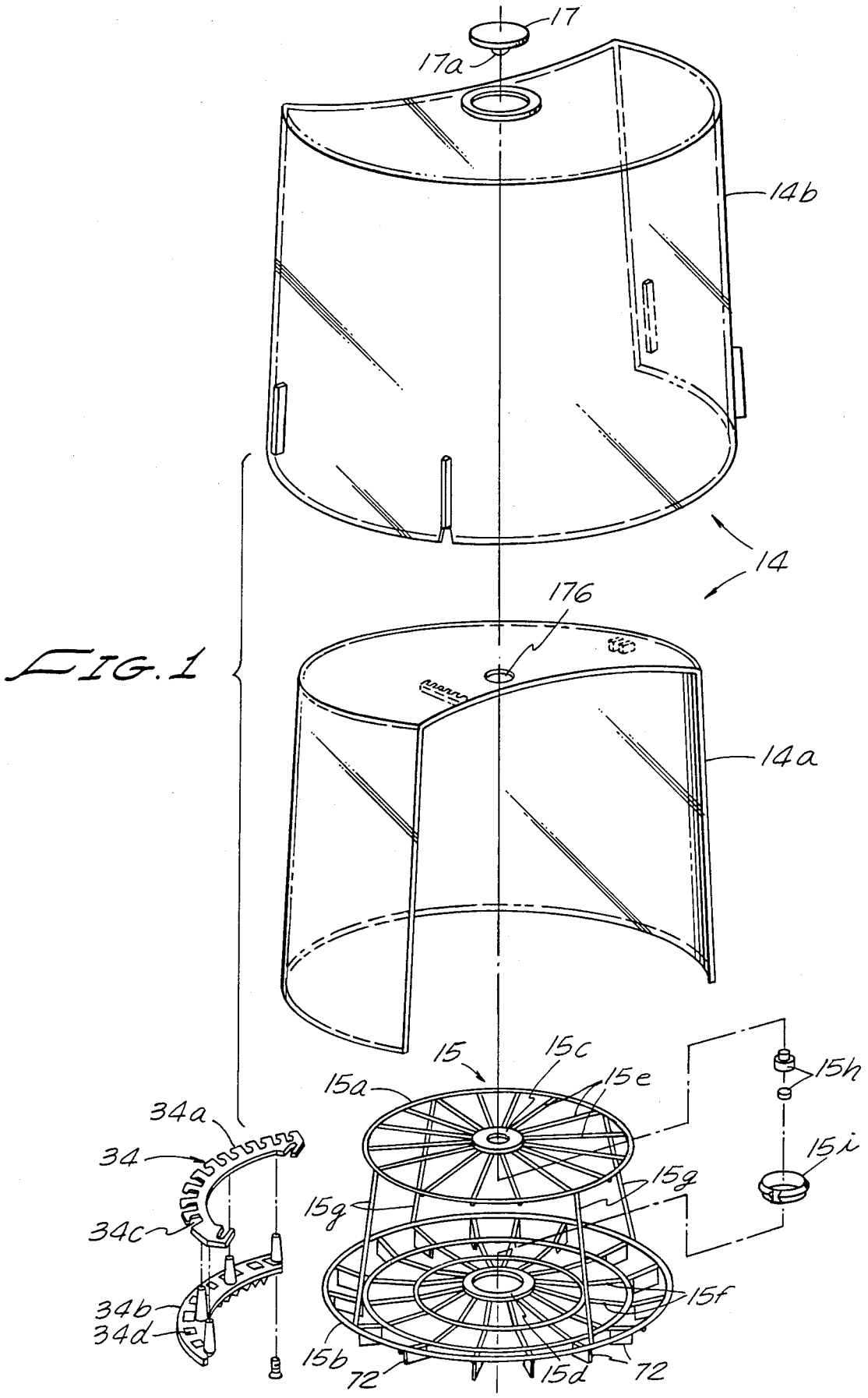
FIG. 1 is an exploded generally perspective view of the outer housing and article supporting racks of the apparatus of the invention.
Figures 2, 11:
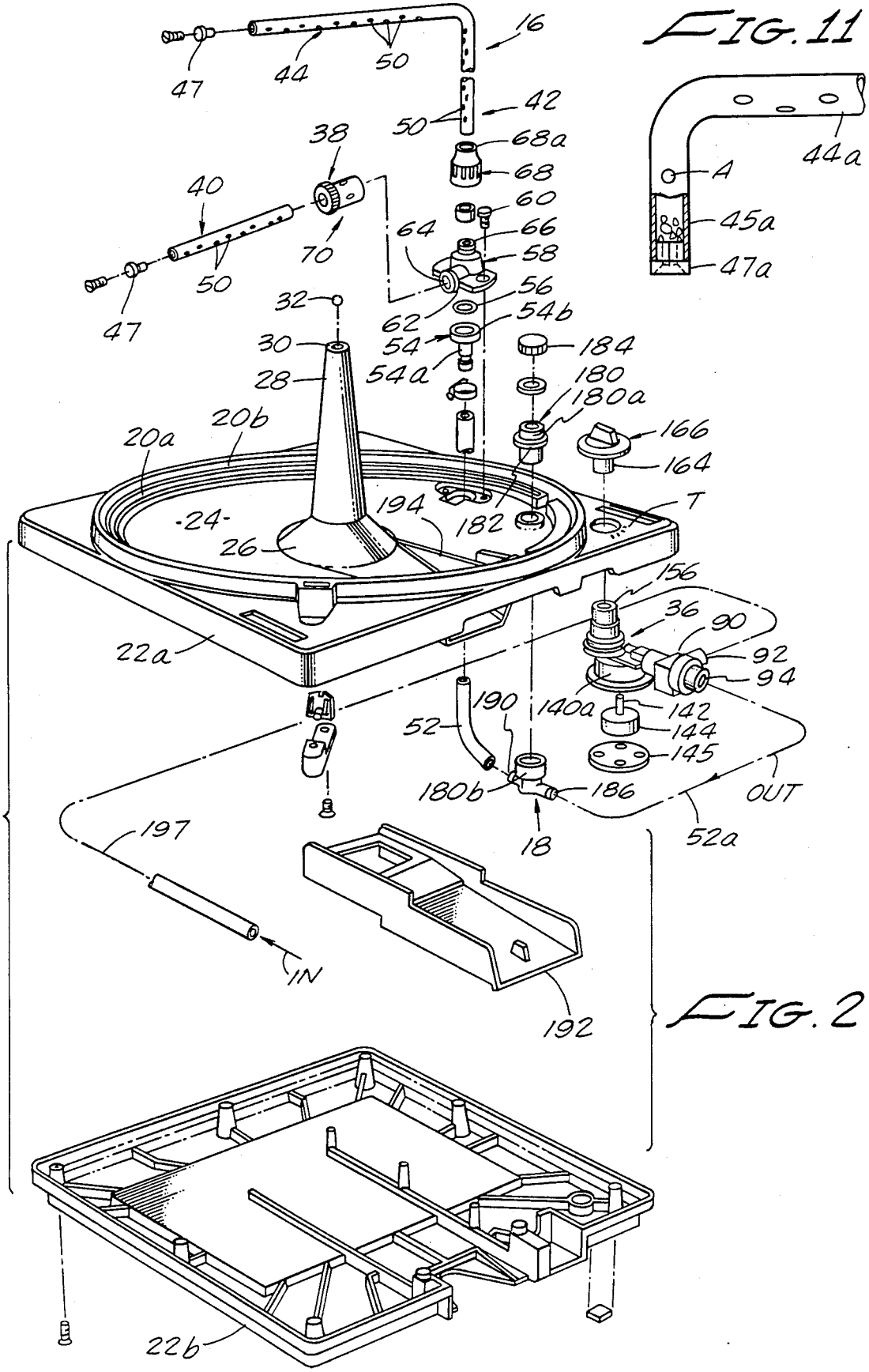
FIG. 2 is an exploded generally perspective view of the base, jet means and control means of the apparatus as they appear with the supporting rack and outer housings removed.
FIG. 11 is a greatly enlarged fragmentary view, partly in cross-section, of an alternate form of spray jet means of the invention.

Referring now to the drawings and particularly to FIGS. 1, 2 and 3, the dishwasher of the present invention, generally designated in FIG. 3 by the numeral 12, includes a housing 14, a rack assemblage 15 mounted for rotation within housing 14, jet means 16 for directing a jet of water at rack assemblage 15 to impart rotational movement thereto, and dosing means 18 adapted to cooperate with the jet means for dosing with an emulsifier water flowing through the jet means.

As shown in FIG. 1, the housing 14 of the unit, which can suitably be constructed of thin plastic or sheet metal, comprises a first stationary part **14*a* and a rotatable part 14*b*** which comprises the closure means of the apparatus. While the housing shown in the drawings is generally cylindrical in shape, it could be constructed in other configurations to meet particular design requirements.

Referring to FIGS. 2 and 3, the housing 14 is received in concentric, circular tracks **20*a* and 20*b* formed in the upper portion 22*a* of a generally rectangular base 22. The fixed portion 14*a* of the housing is sealably received in track 20*b* while the movable portion 14*b* of the housing is received for sliding movement within track 20*a*. To assist the smooth rotational movement of the housing 14*b* relative to the housing 14*a*, a top closure member 17 is provided within a spherical bearing 17*a* which is rotatably received within a recess 17*b* formed in the top surface of housing 14*a***.

As best seen in FIG. 2, track **20*b* defines the outer periphery of a floor 24 which slopes radially inwardly toward a frustoconically shaped, upwardly extending hub 26. Extending upwardly from hub 26 is a frustoconically shaped column 28 having at its upper end a recess 30 adapted to closely receive a ball bearing 32. The upper portion 22*a* of the base is affixed to a lower portion 22*b*** to form an internal cavity, the purpose of which will be presently discussed.

Turning once again to FIG. 1, rack assemblage 15 includes a rack having upper and lower circularly shaped members **15*a* and 15*b* and apertured hub portion 15*c* and 15*d*. Radiating outwardly from these hub portions are a plurality of spokes 15*e* and 15*f*. The upper and lower members 15*a* and 15*b* are maintained in a vertically spaced apart location by four supports 15*g*. Receivable with the apertures of hub portions 15*c* and 15*d* are inserts 15*h* and 15*i***. The rack is preferably constructed of coated steel wire and is specially configured to carry and strategically position various items of crockery, cutlery, dishes and cookware with the housing and in a specific relationship with respect to the spray jet means.

As shown in FIG. 3, rack assemblage 15 is rotatably supported by column 28 with insert **15*i* being disposed in close proximity with the lower portion of the column and with insert 15***h* resting upon and being rotatably supported by the ball bearing 32. With this arrangement the rack assemblage is freely rotatable with housing 14 about the central column 28.

Also forming a part of the rack assemblage 15 is a uniquely configured silverware holder 34 comprising upper and lower members 34*a* and 34*b*. These members, which are held in a vertically spaced apart position by means of adjacent pairs of the supports 15*g*, are provided with silverware support means for positioning the silverware to be washed at a slight angle with respect to the vertical axis of the unit. More specifically, the upper member 34*a* is provided with a plurality of circumferentially spaced apart hook-like protrusions 34*c* which define openings therebetween adapted to receive the handle portion of the silverware. Similarly lower member 34*b* is provided with a plurality of circumferentially spaced apart apertures 34*d*, or recesses, adpated to support the opposite end of the silverware. Apertures 34*c* and 34*d* are angularly offset so that the silverware will be maintained on an angular, or sloping, orientation during the washing operation which has been found to be optimum for an efficient scrubbing action by the water spray jets.

In the embodiment of the invention shown in the drawings, the jet means 16 comprises a collimated jet means for directing a collimated stream of water at the lower peripheral portions of the rack assemblage and a spray jet means for providing the washing action and for continuously urging controlled rotation fo the rack assemblage. To control the rotation of the rack, control means is provided. This control means is cooperatively associated with the spray jet means and the collimated jet means to control the flow of the domestic water thereto.

Turning to FIGS. 2, 4, 5 and 6, the control means of the invention can be seen to comprise timer valve means 36 for regulating the flow of water from the domestic water system, or water source, to the jet means and diverter means 38 for selectively dividing the flow of water between the collimated jet means and the spray jet means.

As best seen by referring to FIGS. 2 and 3, in the present embodiment of the invention, the second spray jet means is provided in the form of a specially configured hollow tubing comprising a first substantially horizontal extending conduit leg portion 40 extending beneath rack assemblage 15, a substantially vertically extending conduit leg portion 42 disposed proximate the periphery of rack 15 (FIG. 3) and a substantially horizontally extending portion 44 disposed above rack 15. The inboard ends of portions 40 and 44*a* are closed by plug assemblages 47.

The tubing of the spray jet means may be constructed from copper, aluminum, plastic or other suitable durable material which can be bent into the configuration shown in FIGS. 2 and 3. In FIG. 2 it can be seen that a multiplicity of small holes 50 are drilled in a specific pattern in each of the leg portions as well as in the vertically extending portion of the tubing. The pattern of holes 50 is carefully engineered to create a three dimensional water spray pattern within housing 14 which sustains rotation of rack 15 and produces a unique scrubbing type of cleansing action on the dishes and cookware supported in rack assemblage 15. The velocity of these jets coupled with the three dimensional pattern thereof creates a highly novel and unique scrubbing action upon the articles supported within rack assemblage 15.

The spray jet means is in communication with the domestic water supply via the dosing means 18 through conduit 52 one end of which is connected to a connector 54 which forms a part of the spray jet means (FIG. 2). The dosing means is, in turn, connected to the timer valve means 36 by conduit 52*a*. Connector 54 has a shank portion 52*a* and a flange portion 54*b*. Shank 54*a* extends through floor 24 for connection with conduit 52 and flange 54*b* is provided with a groove adapted to receive a resilient O-ring 56 which is disposed in sealing engagement with the lower surface of a "T" adapter 58. Adapter 58 is affixed to floor 24 by threaded connectors 60.

As seen in FIG. 2, adapter 58 has an inlet passageway 62 in communication with connector 54, a first outlet 64 adapted to communicate with leg portion 46 via the collimated jet means and a second outlet 66 adapted to rotatably receive the lower end of leg portion 42 of the spray tube. Outlet 66 is externally threaded to accommodate a closure member 68 having a throat portion 68*a* within which the lower end of the leg portion 42 of the spray tube is closely received. With this arrangement the spray tube can be rotated angularly with respect to the rack assemblage about its vertically extending axis by simply loosening closure member 68. In the present embodiment of the invention closure member 68 and adaptor 58 comprise the primary components of the adjustment means for adjusting the orientation of the spray jet means. While the components are shown as threadably interconnected, other connections such as slipfit or bayonet-type connections can be used. By adjusting the spray tube in the manner described, the angle at which jets of water eminating from the spray tube strike the dishes emplaced upon the rack assemblage can be precisely adjusted. This enables precise control over the speed of rotation of the rack assemblage during the washing cycle and insures an optimum scrubbing action by the jets of water striking the dishes at the most effective angle.

Figures 8, 9, 10:
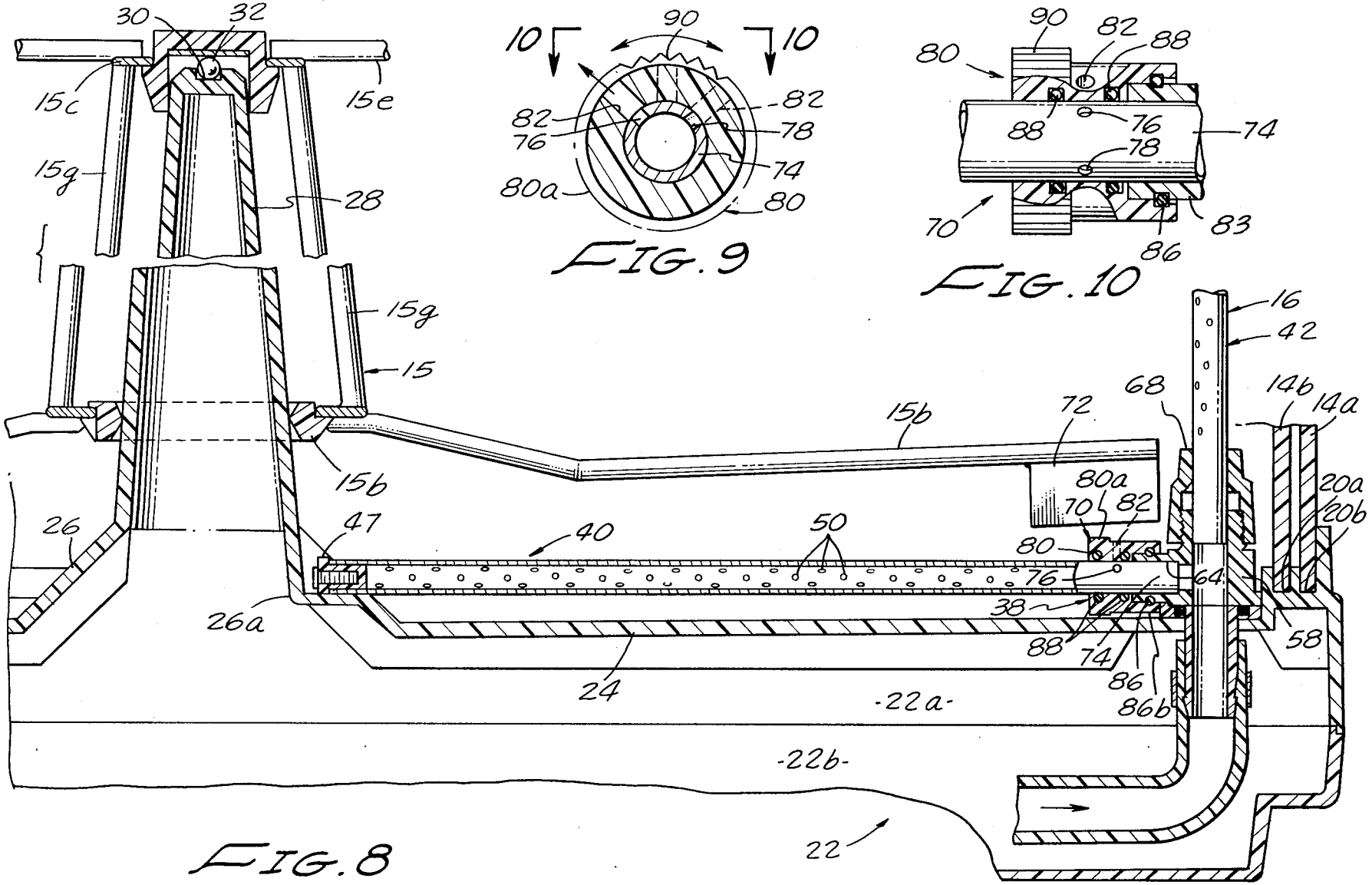
FIG. 8 is a fragmentary side elevational cross-sectional view of the apparatus showing the construction of the collimated jet means and other portions of the control means and the spray jet means.
FIG. 9 is an enlarged fragmentary cross-sectional view of the diverter means portion of the control means of the invention for selectively dividing the flow of water from the timer valve between the collimated jet means and the spray jet means.
FIG. 10 is a cross-sectional view taken along lines 10—10 of FIG. 9 further illustrating the construction of the diverter means.

Referring now to FIG. 8 it is to be noted that the inboard end of leg portion 40 is supported by frustoconical portion 26*a* and in this way is at all times maintained in a spaced relationship with the sloping floor 24 and out of contact with the dishwater as it drains toward the center of the unit.

As best understood by referring to FIGS. 3 and 8, the collimated jet means, generally designated by the numeral 70, is disposed proximate the interconnection point of the horizontal spray tube 40 and the vertical spray tube 42. This important means functions to emit a collimated stream of water in the direction of depending vanes 72, which vanes depend from the outer periphery of rack member 15*b*. In the present embodiment of the invention the collimated jet means comprises a length of conduit 74 disposed intermediate the junction of the lower horizontal portion and the vertically extending portion of the spray tubes 40 and 42 of the spray jet means. Conduit 74 is provided with strategically located circumferentially spaced first and second apertures 76 and 78 (FIGS. 9 and 10), the purpose of which will presently be described.

An extremely important aspect of the present invention resides in the unique and improved control means for controlling the flow of water between the collimated jet means and the jet spray means. As previously mentioned, this control means comprises a timer valve means and a diverter means. Considering the diverter means first, this means comprises a rotatable control member 80 (FIGS. 8, 9 and 10) having a radially extending aperture 82 formed therein. Control member 80 is rotatably carried by conduit 74 and is angularly movable relative to conduit 74 from a first position as shown in FIG. 9 wherein aperture 82 is aligned with aperture 76 formed in length of conduit 74 to a second position wherein the walls of the control member are blocking aperture 76 (see the intermediate phantom lines in FIG. 9). When the control member is in the first position a collimated jet of water under pressure is directed at vanes 72 in a manner to urge forward rotation of the rack assemblage 15 (FIG. 3). When the control member is rotated to said second position, flow of water through the collimated jet means will be blocked and all of the water coming from the domestic water source will flow through the spray jet means.

Another unique aspect of the present invention resides in the fact that the control member 80 can be moved to a third position wherein aperture 82 is aligned with aperture 78 formed in tube portion 74 (see phantom lines at the right of FIG. 9). In this third position, since apertures 76 and 78 are circumferentially spaced by approximately 90 degrees, the collimated jet means is directed in a rearwardly direction and thereby functions to brake the forward rotation of the rack assemblage.

The novel design of the diverter means uniquely permits accommodation of high, low and medium domestic water source pressures. When the domestic water pressure is low, the diverter is set at the first position wherein the collimated jet means is assisting the spray jet means in overcoming starting inertia and in maintaining uniform rotation of the rack assemblage at an optimum rate of speed. In cases where the domestic water pressure is nominal, the diverter is set at the second position blocking flow of water to the collimated jet means. In this situation the rack assemblage is rotated at an optimum speed solely by the spray jet means. In instances of high domestic water pressure, the control member of the diverter means can be set at the third position wherein the collimated jet is directed at the vanes in a rearward direction tending to brake, or slow, rotation of the rack assemblage.

As will be appreciated from an analysis of FIG. 9, fine adjustments of the collimated jet means can be made by rotating the control member 80 so that apertures 76 and 78 are partially covered rather than indexed in the manner shown in FIG. 9. In this way, domestic water pressures in the low to medium and in the medium to high range can also uniquely be accommodated.

Turning particularly to FIG. 8, member 80 can be seen to have an enlarged diameter portion **80*a* and a skirt portion 80*b*. Skirt portion 80*b* is closely received over, and rotatably movable relative to, an outwardly extending tubular portion 83 which is integrally formed with adapter 58 and defines first outlet 64. Both skirt portion 80*b* and tubular portion 83 are grooved to receive a split ring member 86 which rotatably interconnects the parts. Portion 80*a* and skirt portion 80*b* are also provided with circumferentially extending grooves adapted to receive elastomeric O-rings 88 which prevent water leakage between the rotatably interconnected members. As indicated in FIG. 9, portion 80*a* of control member 80 is knurled or grooved at 90** to facilitate rotation of the member among the first, second and third positions.

Figure 5:
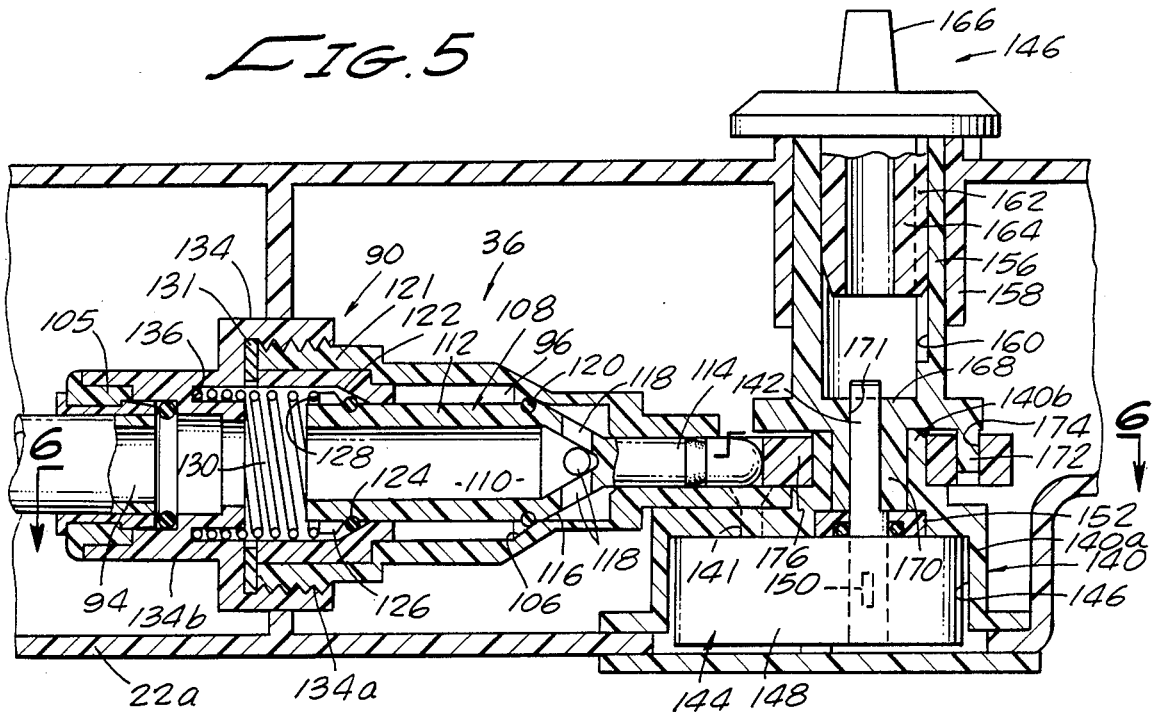
FIG. 5 is a fragmentary cross-sectional view taken along lines 5—5 of FIG. 4 showing the internal construction of the timer valve.
Figure 6:
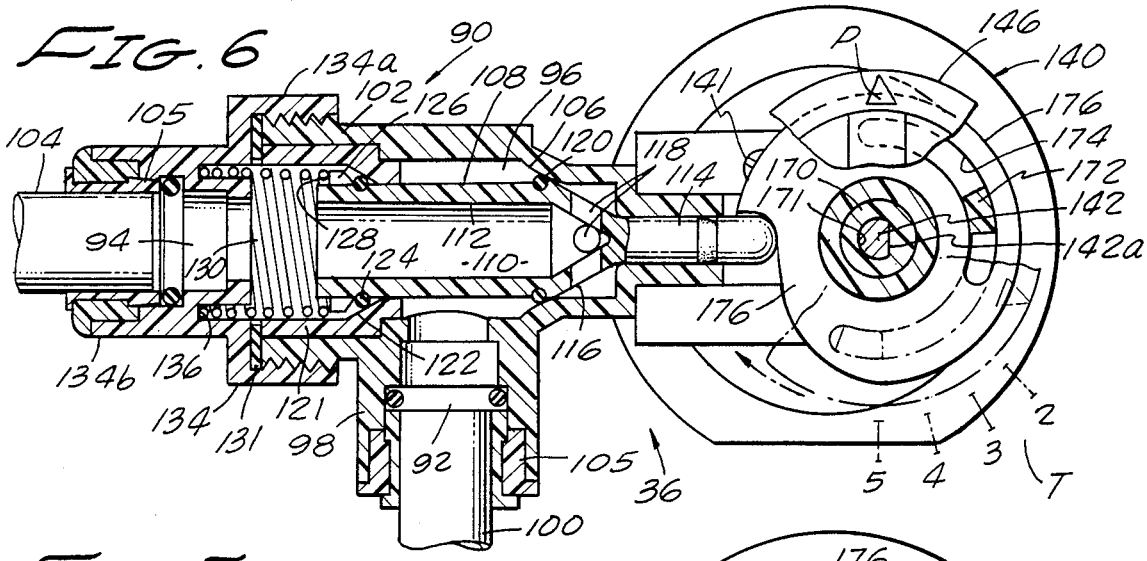
FIG. 6 is a fragmentary cross-sectional view of the timer valve taken along lines 6—6 of FIG. 5 showing the valve in a closed position blocking the flow of water toward the water jet means.

Turning now to FIGS. 4 through 6, the timer valve means portion of the control means is there illustrated. This valve means functions to regulate the flow of water from the domestic source of water under pressure to the jet means and comprises a housing 90 provided with a water inlet 92 and a water outlet 94. Housing 90 is generally L-shaped in plan, having an internal chamber 96 (FIG. 5). A first leg 98 of the housing is adapted to be interconnected with an inlet conduit 100 while an externally threaded second leg 102 is adapted to be interconnected with an outlet conduit 104 (FIG. 6). The conduits are connected to the housing by means of slip fit, quick couplings 105 which are commercially available and from no part of the present invention. A first internal valve seat 106 is formed within chamber 96 intermediate the flow path of the water flowing between the inlet and the water outlet.

Reciprocally movable within chamber 96 is a valve member 108 which is normally disposed in a first closed position wherein a seat engaging portion thereof is in sealable engagement with the valve seat 106 in the manner shown in FIGS. 5 and 6. In this closed position valve member 108 functions to block the flow of water between the water inlet and the water outlet. However, as illustrated in FIG. 7, valve member 108 is movable from the first closed position into a second open position wherein the seat engaging portion of the member is spaced apart from the valve seat 106.

Valve member 108 is generally cylindrical in shape, having an internal fluid passageway 110 formed within the elongated body portion 112 of the valve member. Interconnecting body portion 112 with a stem portion 114 is a tapered wall portion 116 having formed therein a plurality of circumferentially spaced apertures 118. As indicated in FIGS. 5 and 6, valve member 108 engages valve seat 106 at a location proximate the intersection of the tapered wall portion 116 and the body portion 112. To assist in forming a fluid tight seal, the valve member 112 is provided with a circumferentially extending groove adapted to carry an elastomeric O-ring 120 which is adapted to sealably engage valve seat 106 when the valve is in a closed position.

Disposed within the rearward, or left, portion of chamber 96 is an annular shaped member 121, the forward inwardly tapering wall portion of which forms a second valve seat 122. Valve member 108 is also provided with a second annular groove adapted to receive a second elastomeric O-ring 124 which, when the valve is in a closed position, is adapted to sealably engage second valve seat 122. This second sealing arrangement functions to preclude flow of water from the inlet 100 rearwardly or to the left of the housing as viewed in FIGS. 5 and 6.

Figure 7:
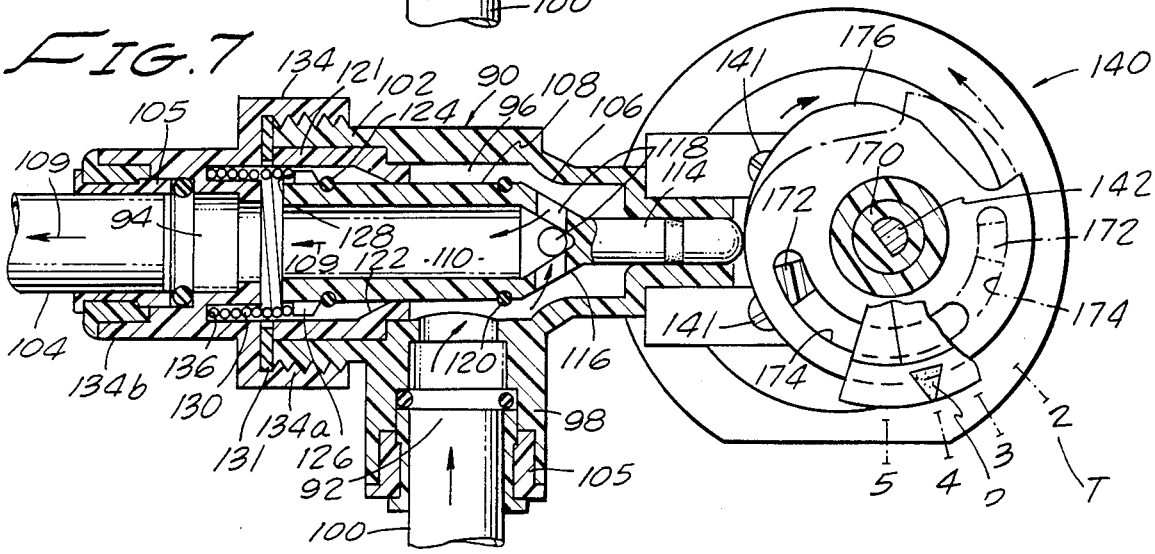
FIG. 7 is a cross-sectional view of the timer valve similar to FIG. 6 but showing the valve in an open position.

When the valve is in an open position as shown in FIG. 7, water will flow into the valve through the inlet 92, past seat 106, through apertures 118 in the valve member and rearwardly in the direction of the arrows 109 toward outlet 94.

Extending radially outwardly from body portion 112 proximate the left end thereof are spring retainer means 126 which define shoulders 128 adapted to engage biasing means, provided herein in the form of a coil spring 130, which surrounds the rear, or left hand, extremity of body 112 of valve member 108.

Threadably interconnected with housing 90 is an adapter member 134 which includes an internally threaded enlarged diameter portion **134*a* and a smaller diameter cylindrical portion 134*b*** within which conduit 104 is removably received. Adapter 134 functions to hold member 120 in position within chamber 96 and also is provided with a circumferential, axially extending groove 137 which receives the rear, or left, portion of spring 130. With the biasing means or coil spring 130 positioned within the valve in the manner illustrated in FIGS. 5 and 6, the forward extremity of the spring is in engagement with shoulder 128 while the rear extremity is in engagement with the end wall of groove 136. With this construction, the biasing means, or spring 130, functions to yieldably resist movement of the valve member from the first closed position shown in FIGS. 5 and 6 to the second open position shown in FIG. 7. A rubber gasket 131 is disposed between housing 190 and adapter 34 to prevent leakage of water rearwardly of the housing.

Also forming a part of the valve means of the present invention are operating means for moving the valve member from the first closed position to the second open position and for maintaining the valve member in the second position for predetermined periods of time. In the present embodiment of the invention the operating means comprise cam means and actuating means which are carried by a second housing 140, which housing is connected to valve housing 90 by means of connectors 141 (FIGS. 5 and 7). The cam means is adapted to interact with stem portion 114 of the valve member to move the valve member from the first closed position to the open second position upon movement of the cam means in a first direction. Operably associated with the cam means are actuating means which function to move the cam means a predetermined distance in a first arcuate direction, from a first starting point to a second end point, and then for controllably moving the cam means in an opposite direction from the second end point to the first starting point in a predetermined elapsed time. With this construction, the actuating means initially functions to rotate the cam means in a first direction, which in turn moves the valve member from the first closed position to the second open position against the urging of the biasing means or spring 130. The actuating means then rotates the valve member in the opposite direction from the second position to the first, or starting, position in a predetermined elapsed time permitting the valve member to automatically return to the first closed position due to the urging of spring 130.

In the present embodiment of the invention, the actuating means comprises a shaft 142 which is rotatably carried within housing 140, a motor means 144 connected to one end of the shaft and a handle means 146 connected to the opposite end of the shaft. As best seen in FIG. 5, the housing 140 comprises an enlarged diameter portion 140*a* defining a chamber 146 and an upper cylindrically shaped portion 140*b*. Contained within chamber 146 is the motor means which can be any one of a number of types of commercially available mechanical motors capable of driving shaft 142 at a predetermined rate of rotation. The motor means is held within chamber 146 by an apertured closure base plate 145. In the drawings (FIG. 5), the motor means is shown as comprising a spiral spring 148 formed of an elongated strip of spring steel which has been wound into the shape of a loose spiral. Spring 148 is provided proximate its inner end with a tab which is adapted to be interconnected with shaft 142 through insertion of the tab into a slot 150 formed in a shaft 142 which extends upwardly from chamber 142 through a suitable bushing 152, carried by housing 140. The outer extremity of the spiral spring is connected to the housing 140 so that rotation of shaft 142 in a first direction will tend to wind or tighten spiral spring 148 to a predetermined tension. Once the spring is wound and the handle means is released the spring will then tend to unwind, causing shaft 142 to rotate in a second, opposite direction. Spring motors of this character are well known in the prior art and can be calibrated so that the unwinding of spring 148 and the counter-rotation of shaft 142 can be accurately correlated with time.

In the form of the invention shown in the drawings, the cam means and the cooperating handle means are of highly novel design. Referring particularly to FIG. 5, the handle means comprises a first cylindrical portion 156 which is rotatably carried within a depending sleeve 158 which is formed as a part of the upper portion 22*a* of base 22. Cylindrical portion 156 is provided with a keyway 160 which receives a key 162 formed on the shank portion 164 of a handle 166. With this construction, rotation of handle 166 will cause rotation of cylindrical portion 156.

Formed at the lower extremity of cylindrical portion 156 is a centrally apertured base plate 168 having depending therefrom a central portion 170. Portion 170 is provided with a central bore 171 having a flat surface which is adapted to mate with shaft 142 which is also provided with a flat surface 142a (FIG. 6). Accordingly, when shaft 142 is telescopically received within bore 171, rotational movement of handle 166 will cause corresponding rotational movement of shaft 142.

Provided proximate the periphery of base plate 168 is a depending finger 172 which, as best seen in FIG. 6, is closely receivable within an arcuate slot 174 formed in a cam plate 176 which comprises a part of the cam means of the invention. With this construction, rotational movement of handle 166 in a first, clockwise direction will cause finger 172 to also rotate cam plate 176 in a first clockwise direction from the position shown in FIG. 6 to the position shown in FIG. 7. Because of the novel configuration of the peripheral surface of cam plate 176, rotation of the cam plate will cause the outer periphery of the plate, which is in constant contact with stem 114 of the valve member 108, to move the valve member against the urging of spring 130 into the open position shown in FIG. 7.

When handle 166 is released, the spring motor will cause the shaft 142, along with the handle means, including finger 172, to move in the opposite, or counterclockwise direction at a predetermined rate of rotation. As shaft 142 rotates, finger 172 will move within slot 174 from the position shown in the solid lines of FIG. 7 to the position shown in the phantom lines of FIG. 7. When the finger reaches the end of slot 142 the motor will cause rotation of cam plate 176 in a counterclockwise direction caming it to return to its starting point as shown in FIG. 6. With the cam plate in this position spring 130 will have moved the valve member 108 to the right into the closed position shown in FIG. 7 thereby blocking further flow of water through the valve means.

Since the motor 144 drives shaft 142 at a known rate of speed, the time required for the finger 172 to move from one extremity of the slot 174 to the other can easily be determined. This time will represent the minimum time period during which the valve will remain open. Once the end of slot 174 is reached, the speed of rotation of the cam plate by the finger 172, will be the same as the speed of rotation of the shaft 142. This being the case, the time required for the cam plate to return to its starting position from various rotational positions of the handle 160 can also be easily determined. These times when added to the minimum time period previously discussed will give the total time period during which the valve will remain open. Accordingly, calibrations representing time can be marked on the upper surface of the housing as indicated by the numerals 2 through 5 in FIGS. 6 and 7 (identified by the letter "T"). By inscribing an arrow or pointer "P" on handle 166 and by rotating the handle until the arrow aligns with one of the calibration marks "T", the time of operation of the dishwasher can selectively be set by the operator. Obviously the greater the amount of initial clockwise rotation of the handle 166 and the com plate 176, the longer will be the time period during which the valve means remains open. If desired, signal means such as a bell can be incorporated into the control means to signal the close of the valve and the completion of the washing cycle.

Also forming a part of the apparatus of the present invention is the previously mentioned dosing means 18 which is adapted to cooperate with the jet means for dosing the water flowing through the jet means with an emulsifier. In the present form of the invention, the dosing means comprises a housing 180 having an upper chamber **180*a* (FIG. 2) disposed above floor 24 and a lower chamber 180*b* disposed below floor 24. Chambers 180*a* and 180*b* are divided by a partition 182 and are in communication with one another via holes extending through the partition. Chamber 180*a* is closed by a cap 184 which is removably interconnected to housing 180 by any suitable means. With the cap removed, a liquid or powdered soap can be added to chamber 180*a*. The dosing means has an inlet 186 which is connected to the outlet 94 of valve means 36 by means of conduit 52*a* and an outlet 190 which is connected to the jet means by conduit 52**. Flow of water through the dosing means will cause the soap to mix with the water and to flow toward the spray jet means.

Another feature of the improved dishwasher of the present invention is a retractable drain trough 192 (FIG. 2) which conveniently slides into and out of a guide 194 disposed within the cavity defined between the upper and lower base members **22*a* and 22*b*. As best seen in FIG. 2, the guide 192 is integrally formed with floor 24 and is in communication with the washing chamber so that when trough 192 is in an extended position water will flow by force of gravity along the sloping floor 24** into the trough for deposition into an adjacent sink or drain conduit. The drain trough is of a capacity sufficient to adequately drain the apparatus with no fear of the water level therein rising above a safe, predetermined level.

OPERATION

In operating the apparatus of the embodiment of the invention shown in the drawings, the entire unit may be conveniently placed on a sink cabinet with the trough 192 being movable into the extended position shown in FIG. 3 overhanging the sink portion of the sink cabinet. In this position, water flowing from the interior of the unit along trough 192 will be safely deposited into the sink for drainage through the drain lines attached to the sink unit itself. With the assemblage in position on the sink cabinet, or drainage board, the device can be interconnected with the domestic hot water source.

Once the dishwasher apparatus is interconnected with the hot water line of the domestic supply and the drain trough is extended in the manner shown in FIG. 3, the closure housing 14 is rotated to an open position. In this open position free and convenient access to the rack assemblage 15 is provided. The dishes and silverware to be washed can be placed on the rack assemblage and are strategically supported thereon by the structural elements of the assemblage so that continued rotation of the rack by the jet means will be assure.

Next, the diverter means is set to accommodate the pressure of the domestic water source being used. If the source pressure is low, the control member 38 is set so that the aperture therein aligns with aperture 76 in the conduit 74 of the collimated jet means. With this setting, part of the water will be diverted to the collimated jet means and a collimated jet stream will be directed in a forward direction against the vanes provided at the lower periphery of the rack assemblage. With this setting, both the collimated jet means and the spray jet means will cooperate to rotate the rack.

If the water source is a normal pressure the control member 38 is set to block the apertures in conduit 74 thereby permitting all of the water to flow to the spray jet means.

On the other hand, if the domestic water source is at high pressure, the aperture in the control member 38 is aligned with aperture 78 in the conduit 74. With this setting, the collimated jet means will direct a reverse stream of water at the vanes tending to brake the speed of rotation of the rack.

Once the diverter means is set and the dishes and silverware have been loaded into the dishwasher apparatus, the rotatable portion of the closure housing can be moved into a closed position. With the rotatable portion of the closure housing is disposed in this closed position, the unit will be entirely waterlight and the only water coming from the unit will be water draining through drain trough 192 into the sink.

With the closure housing in the closed position, the hot water valve or faucet may be turned on, causing water to flow into apparatus through the "In" conduit 197 (FIG. 2). However, since the valve means is normally closed, no water will flow through the valve until the handle 166 is rotated to the desired time setting. By rotating handle 166 in a clockwise direction, the motor spring will be wound and the cam plate 176 will be rotated causing valve member 108 to move into an open position against the urging of spring 130. This opening of the valve will permit water to flow toward the water jet means through conduits **52*a* and 52**.

After the handle 166 is set the motor 144 will drive shaft 142 in a reverse, counter-clockwise direction at a predetermined rate of speed. Rotation of shaft 142 will cause finger 172 to pass through the slot 174 in the cam plate and then to rotate the cam plate to its starting position wherein the valve means will automatically close thus completing the washing cycle.

Turning to FIG. 11, there is shown an alternate form of upper spray tube designated as **44*a*. This tube is provided with a downwardly depending leg 45*a* which has at least one aperture "A" formed therein. Leg 45*a* is closed by a removable closure plug 47*a*. With this construction, calcium build-ups and other foreign matter in the water flowing through the spray tubes will tend to collect within depending leg 45*a*. These foreign materials can periodically be removed by removal of plug 47*a***.

Figure 12:
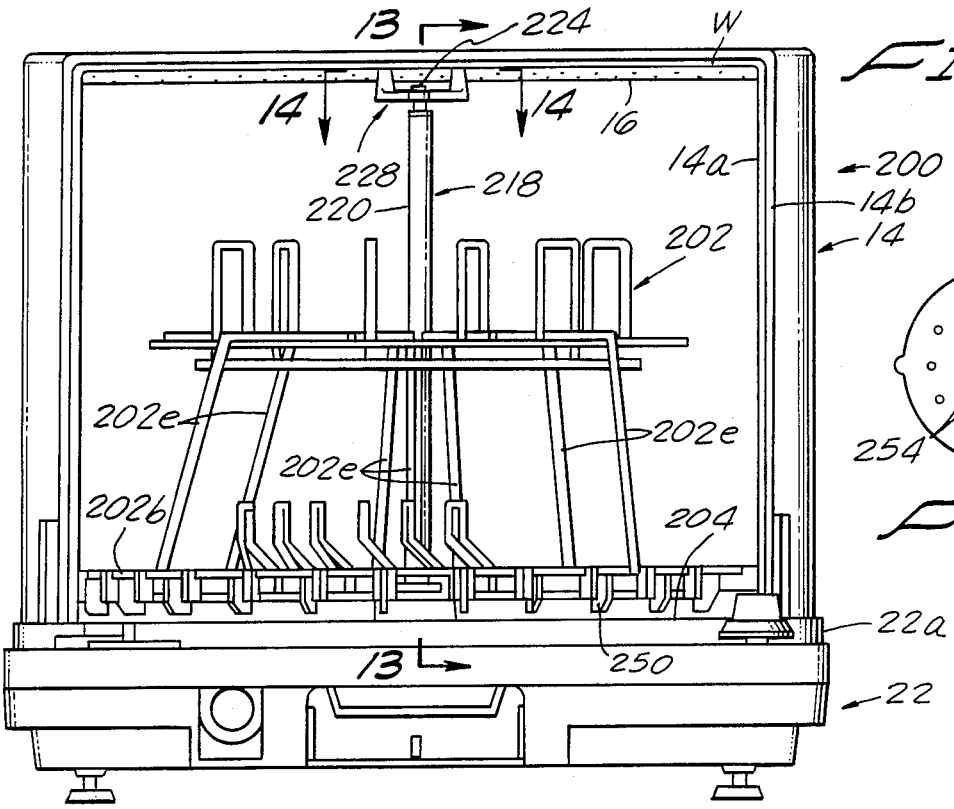
FIG. 12 is a front elevational view of another embodiment of the dishwasher apparatus of the invention.
Figure 13:
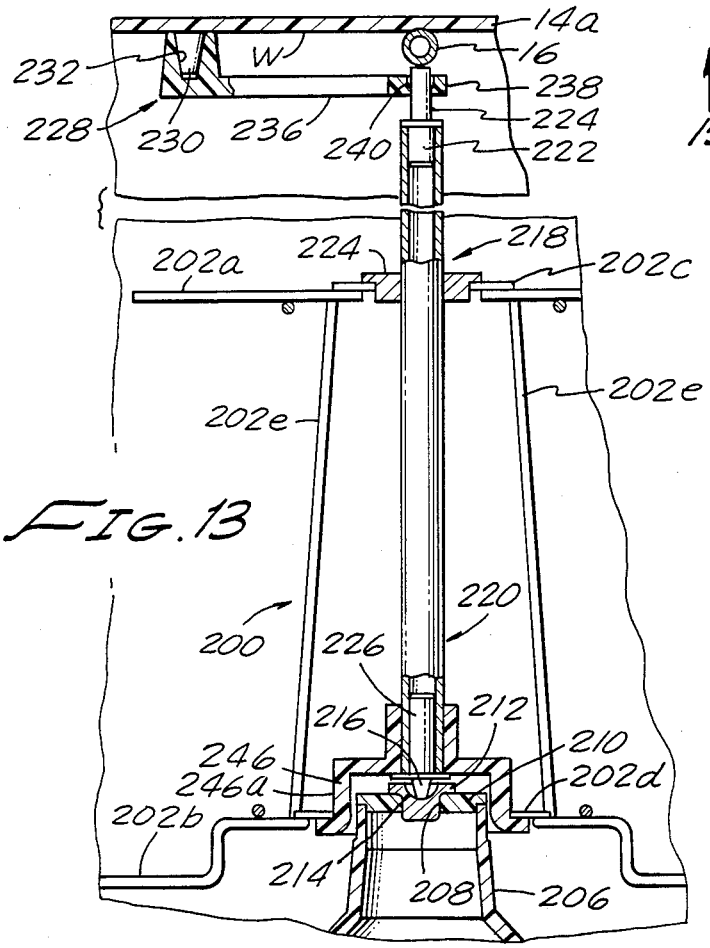
FIG. 13 is a fragmentary cross-sectional view taken along lines 13—13 of FIG. 12.

Referring particularly to FIGS. 12 and 13 of the drawings, there is shown still another form of dishwasher of the present invention, generally designated in FIG. 12 by the numeral 200. Many of the operating components of this form of the invention are identical to those of the embodiments previously described herein and like numerals are used to identify like components. This embodiment of the invention includes a housing 14, and a differently configured rack assemblage 202 mounted for rotation within housing 14 upon a different and unique form of suspension means, the details of which will presently be described.

In the embodiment shown in FIGS. 12 through 15, the jet means 16, including the spray jet means and the collimated jet means, for directing a jet of water at rack assemblage 15 to impart rotational movement thereto and the valve and diverter means for controlling water flow are substantially identical to the means previously described herein and their details of construction will not be repeated.

As shown in FIGS. 1 and 12, the housing 14 of the unit, comprises a first stationary part **14*a* and a rotatable part 14*b* which, as in the earlier described embodiments, comprises the closure means of the apparatus. The housing 14 is received in concentric, circular tracks formed in the upper portion 22*a* of a generally rectangular base 22**.

Disposed interiorly of the tracks is a floor 204 which defines near its center portion a frustoconically shaped, upwardly extending hub 206 (FIG. 13). Located within an aperture 208 formed in the top closure wall 210 of hub 206 is the female portion of a first bearing means, shown here as insert member 212. Member 212 has a generally hemispherically shaped concave portion 214 which defines a female bearing surface adapted to rotatably receive the male portion of the first bearing means, provided here in the form of a frustoconically shaped tip 216 carried by the rack supporting column. Column assembly 218 comprises a rigid tubular main body portion 220 having hollow upper and lower ends. Received within the upper end of portion 220 is part of a second bearing means comprising an insert 222 having an upwardly extending reduced diameter portion 224 which forms the journal of the second bearing means. As best seen in FIG. 13, the male portion of the first bearing means, namely tapered tip 216 is formed on a lower insert 226, which insert is received in the lower end portion of body portion 220 of the column assembly.

Figure 14:
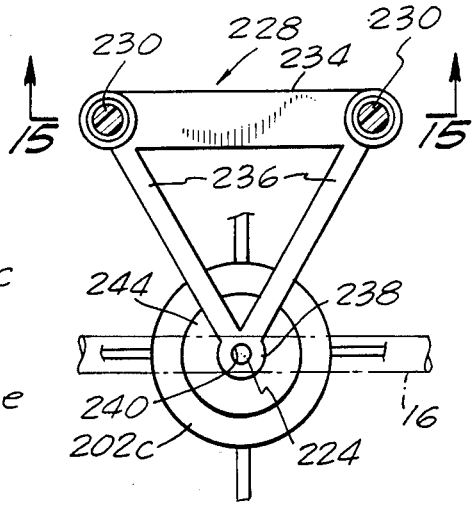
FIG. 14 is an enlarged fragmentary view taken along lines 14—14 of FIG. 12.
Figure 15:
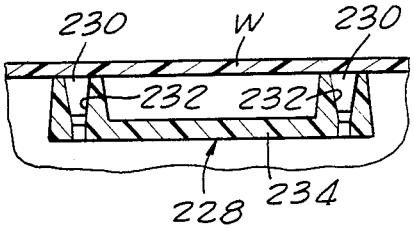
FIG. 15 is an enlarged fragmentary cross-sectional view taken along lines 15—15 of FIG. 14.

Referring particularly to FIGS. 13 and 14, attached to the top wall "W" of part **14*a* of housing 14 is another portion of the second bearing means, shown here in the form of a downwardly depending member 228 which is generally triangularly shaped in plan. Member 228 which rotatably supports the column assembly 218, can be connected to topwall "W" by any suitable means, but preferably is secured as by bonding, press fit or by the use of fasteners to downwardly depending, spaced apart conically shaped protuberances 230 formed integrally with top wall "W". Protuberances 230 are closely receivable within spaced apart, conically shaped openings 232 formed proximate the ends of a main leg 234 of member 228. Extending angularly inwardly from leg 234 are two legs 236 which complete the triangle and cooperate to form an apex portion 238. Apex portion 238 is provided with an aperture 240 which forms the bearing of the second bearing means adapted to rotatably receive the journal portion 224 of insert 222**.

While various materials can be used in the construction of the column assembly and bearing means, the column assembly and first bearing member 212 are preferably constructed of a rigid stainless steel or nickel plated steel. Members 210 and 228, on the other hand, are preferably constructed of glass-filled nylon, teflon or other similar low friction materials.

Turning once again to FIGS. 12 and 13, rack assemblage 202 includes a rack having upper and lower circularly shaped members **202*a* and 202*b* and apertured hub portions 202*c* and 202*d* (FIG. 13). Radiating outwardly from these hub portions are a plurality of spokes. The upper and lower members 202*a* and 202*b* are maintained in a vertically spaced apart location by a plurality of supports 202*e*. Receivable with the apertures of hub portions 202*c* and 202*d* are annular shaped inserts 244 and 246 (FIG. 13). These inserts, which are preferably constructed of glass-filled nylon, teflon or the like, telescopically receive body portion 220 of column assembly 218 and function to removably interconnect the rack assembly and the column assembly so that the rack assembly is freely rotatable within the housing 14. As best seen in FIG. 13, insert 246 has an enlarged diameter lower portion 246*a* which is closely receivable over hub 206** when the rack is in position on the column assembly. The rack is preferably constructed of coated steel wire and is specially configured to carry and strategically position various items of crockery, cutlery, dishes and cookware within the housing and in a specific relationship with respect to the spray jet means.

With the construction of the central column assembly, the rack assembly and the first and second bearing means as described in the preceding paragraphs, the axes of the column assembly and the rack assembly are maintained in precise alignment with the vertical centerline of the housing 14. Because of the unique construction of the rigid central column and of the first and second bearing means of the apparatus, the rack assembly, even when fully loaded with dishes, cutlery and cookware, will be precisely maintained in coaxial alignment with the vertical axis of the housing 14 and will freely rotate therewithin with an absolute minimum of frictional drag. More particularly, the male bearing portion 216 of the first bearing means, being tapered toward its lower contact point, has minimal area contact with, and is freely rotatably within, the concave female bearing portion 214. Similarly, the journal portion 224 of the second bearing means is freely rotatable within the aperture 240 provided in the apex portion of the triangularly shaped, low friction material member 228. The choice of materials for the column assembly insures that the rack assembly will run true with minimum distortion. Similarly, the choice of materials for the bearing means insures that minimum frictional drag will occur during operation of the apparatus. Accordingly, an absolute minimum amount of force is required to start and to maintain free rotation of the rack assembly. This being the case, and as will be discussed in greater detail in the paragraph which follows, the dishwasher of this form of the invention is ideally suited for operation in areas of abnormally low domestic water pressure.

As in the previously described embodiments, in the embodiment of the invention shown in FIGS. 12 through 15 of the drawings, the jet means 16 comprises a collimated jet means for directing a collimated stream of water at the depending vanes 250 disposed about the lower, outermost peripheral portion of the rack assemblage and further comprises a spray jet means for providing the washing action and for continously urging smooth rotation of the rack assemblage. To control the rate of rotation of the rack, control means of the same character as previously described herein are provided. However, in this latter form of the invention, free rotation of the rack assembly is substantially enhanced because of the unique construction of the suspension means, included in the previously described column assembly and bearing means. Accordingly, this last described embodiment of the invention can successfully be used in areas having lower domestic water pressure than those in which the former embodiments of the invention can successfully be used.

Figure 16:
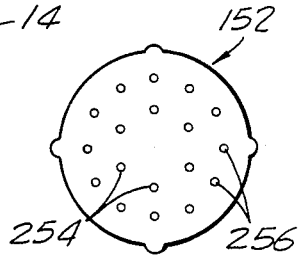
FIG. 16 is a greatly enlarged plan view of a diverter plate adapted for use in connection with the dosing means of the invention.

Turning now to FIG. 16, another improved feature of this last to be described form of the invention resides in the provision, within the dosing means, of unique emulsion metering means 252 of the configuration thereshown. This metering means, which is inserted within upper chamber 180*a* of the dosing means housing 180 (FIG. 2) and rests proximate portion 182, effectively controls and precisely meters the flow of the emulsion into the stream of water flowing toward the spray jet means. The precise metering of the emulsion is made possible by the strategically located inner and outer rings of spaced apertures 254 and 256 respectively. With disk 252 in place within the dosing means, the soap, or emulsion, is uniformly metered through the rings of apertures from chamber 180*a* into the water flowing through the dosing means in a precisely controlled manner such that uniform amounts of the soap will impinge on the dishes and cookware within the rack throughout the entire washing cycle.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope claims.

We claim:

1. A dishwasher adapted to be interconnected with a source of water under pressure, comprising:

(a) a base;

(b) a closure housing carried by said base said closure housing having a central axis and interconnected top and side walls;

(c) a rack adapted to support articles to be washed having upper and lower peripheral portions interconnected by upstanding portions;

(d) rack suspension means for supporting said rack for rotation within said closure housing about the central axis thereof comprising:

(1) a rigid generally vertically extending column coaxially aligned with said central axis of said housing;

(2) first bearing means carried by said base for rotatably supporting said column; and (3) second bearing means carried by said top wall of said closure housing for rotatably supporting said column said second bearing means comprising a supporting member for rotationally supporting the upper extremity of said vertically extending column said supporting member being spaced from said top wall of said closure;

(e) jet means interconnected with the source of water under pressure for directing jets of water in the direction of said rack to impart rotational movement thereto, said jet means comprising:

(1) a spray jet means for urging rotation of said rack, said means comprising a first conduit extending beneath said rack, a second generally vertically extending conduit interconnected with said first conduit and disposed proximate the periphery of said rack and a third conduit extending over said rack, a portion of said third conduit extending between said top wall of said closure and said supporting member whereby said third conduit can be superimposed over the central axis of said housing;

(2) a collimated jet means for emitting a collimated stream of water in the direction of said rack; and (3) control means comprising:

(i) valve means for regulating the flow of water from the source of water under pressure to said jet means; and (ii) diverter means disposed proximate the junction of said first and second conduits for selectively diverting the flow of water between said collimated jet means and said spray jet means said diverter means being adjustable to direct said collimated stream of water in a first direction urging counterclockwise rotation of said rack and in a second direction urging clockwise rotation of said rack.

2. A dishwasher as defined in claim 1 in which said first bearing means comprises a male bearing portion carried by said column and a female bearing portion supported by said base, said female bearing portion having a dished-out, concave portion adapted to receive said male bearing portion for rotation therewithin.

3. A dishwasher adapted to be interconnected with a source of water under pressure, comprising:

(a) a base;

(b) a closure housing carried by said base said closure housing having interconnected top and side walls;

(c) a rack having upper and lower peripheral portions interconnected by upstanding portions adapted to support articles to be washed;

(d) rack suspension means for supporting said rack for rotation within said housing, comprising:

(1) a rigid generally vertically extending column having a journal portion at one end thereof and a male bearing portion at the opposite end thereof;

(2) a female bearing carried by said base for cooperative interaction with said male bearing portion of said column; and (3) bearing means carried by said top wall of said closure housing for cooperative interaction with said journal portion of said column;

(e) jet means interconnected with the source of water under pressure for directing jets of water in the direction of said rack to impart rotational movement thereto, said jet means comprising:

(1) a spray jet means for urging rotation of said rack, said means comprising a first conduit extending beneath said rack, a second generally vertically extending conduit interconnected with said first conduit and disposed proximate the periphery of said rack and a third conduit extending over said rack;

(2) a collimated jet means for emitting a collimated stream of water in the direction of said rack; and (3) control means comprising:

(i) valve means for regulating the flow of water from the source of water under pressure to said jet means; and (ii) diverter means for selectively diverting the flow of water between said collimated jet means and said spray jet means said diverter means being adjustable to direct said collimated stream of water in a first direction urging counterclockwise rotation of said rack and in a second direction urging clockwise rotation of said rack and being further adjustable to divert all of the flow of water to said spray jet means.

4. A dishwasher as defined in claim 3 in which said male bearing portion comprises a generally frustoconically shaped tip affixed proximate the lower end of said column and in which said female bearing portion comprises a member supported by said base having a dished-out, concave portion adapted to receive said tip for rotation therewithin.

5. A dishwasher as defined in claim 4 in which said tip and said concave portion of said member are constructed from nickel plated steel.

6. A dishwasher as defined in claim 3 in which said bearing means comprises a member depending from said top wall and having an aperture therein adapted to closely receive said journal portion of said column said member being constructed of a low-friction material.

7. A dishwasher as defined in claim 3 in which said rack comprises centrally disposed upper and lower apertured hub portions adapted to closely receive said column.

8. A dishwasher as defined in claim 7 in which said upper and lower apertured hub portions are constructed from a low friction material.

9. A dishwasher as defined in claim 3, including dosing means carried by said base for cooperation with said jet means for dosing the water flowing through said jet means with an emulsifier, said dosing means comprising a housing having an upper chamber adapted to carry an emulsifier and a lower chamber adapted to receive the water flowing to said jet means, said upper and lower chambers being divided by an emulsifier metering means for controlling the amount of emulsifier passing from said first chamber into said second chamber.

10. A dishwasher as defined in claim 9 in which said emulsifier metering means comprises a disk shaped member having a plurality of spaced first apertures disposed about a ring of a first diameter and a plurality of spaced second apertures disposed about a ring of a second diameter.

11. A dishwasher as defined in claim 3 in which said third conduit extends over the axial centerline of said housing and said rack said vertically extending column of said rack suspension means.

12. A dishwasher as defined in claim 11 in which said diverter means comprises:

(a) a section of said first conduit disposed proximate the periphery of said rack, said section of conduit being provided with a first aperture; and (b) a control member having an aperture formed therein, said control member being movable relative to said section of conduit from a first position wherein said aperture therein is aligned with said first aperture in said length of conduit to a second position wherein said member is blocking said first aperture.

13. A dishwasher adapted to be interconnected with a source of water under pressure, comprising:

(a) a base;

(b) a closure housing carried by said base;

(c) a rack rotatably mounted within said housing, said rack having a lower peripheral portion and a plurality of circumferentially spaced vanes affixed to said lower peripheral portion;

(d) rack suspension means for supporting said rack for rotation within said closure housing about the central axis thereof, comprising:

(1) a rigid generally vertically extending column coaxially aligned with said central axis of said housing;

(2) first bearing means carried by said base for rotatably supporting said column; and (3) second bearing means carried by said top wall of said closure housing for rotatably supporting said column;

(e) jet means interconnected with the source of water under pressure for directing jets of water in the direction of said rack to impart rotational movement thereto, said jet means comprising:

(1) a spray jet means for directing a multiplicity of jets of water at said rack to urge rotation thereof, said spray jet means comprising a first conduit extending beneath said rack, a second generally vertically extending, angularly adjustable conduit interconnected with said first conduit and disposed proximate the periphery of said rack and a third conduit extending over said axis of rotation of said rack, each of said conduits being provided with a multiplicity of small holes located in a predetermined pattern to create a three dimensional water spray pattern within said closure housing to produce a scrubbing type action said second and third conduits being angularly adjustable to precisely control the direction of the spray jets relative to said rack;

(2) a collimated jet means for emitting a collimated stream of water in the direction of said vanes; and (3) control means comprising:

(i) valve means for regulating the flow of water from the source of water under pressure to said jet means; and (ii) diverter means for selectively dividing the flow of water between said collimated jet means and said spray jet means; said diverter means being disposed proximate the junction of said first and second conduits and comprising:

(a) a section of said first conduit disposed proximate the periphery of said rack, said section of said first conduit being provided with first and second apertures; and (b) a control member having an aperture formed therein, said control member being movable relative to said section of said first conduit from a first position wherein said aperture therein is aligned with said first aperture in said section of said first conduit, to a second position wherein said member is blocking said first aperture and to a third position wherein said aperture therein is aligned with said second aperture.

14. A dishwasher as defined in claim 13 in which said third conduit is provided with a downwardly depending leg having at least one aperture formed therein.

* * * * *